US008395564B2

(12) United States Patent
Shin et al.

(10) Patent No.: US 8,395,564 B2
(45) Date of Patent: Mar. 12, 2013

(54) DISPLAY, AND DISPLAY PANEL AND DRIVING METHOD THEREOF

(75) Inventors: Dong-Yong Shin, Suwon-si (KR); Do-Hyung Ryu, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 780 days.

(21) Appl. No.: 11/132,097

(22) Filed: May 17, 2005

(65) Prior Publication Data

US 2005/0264497 A1 Dec. 1, 2005

(30) Foreign Application Priority Data

May 25, 2004 (KR) ..... 10-2004-0037288

(51) Int. Cl.
*G09G 3/30* (2006.01)

(52) U.S. Cl. ..... 345/76; 345/55; 345/83; 345/204; 345/690; 315/169.2; 315/169.3

(58) Field of Classification Search ..... 345/76–83, 345/33, 36, 38, 39, 55, 87, 90, 92, 98, 100, 345/103, 204, 690; 315/169.2, 169.3
See application file for complete search history.

(56) References Cited

U.S. PATENT DOCUMENTS 5,194,974 A * 3/1993 Hamada et al. ..... 349/48
5,721,559 A * 2/1998 Nagakubo ..... 345/63
5,748,165 A * 5/1998 Kubota et al. ..... 345/96
6,011,531 A * 1/2000 Mei et al. ..... 345/92
6,023,260 A 2/2000 Higashi
6,421,033 B1 * 7/2002 Williams et al. ..... 345/55
6,618,031 B1 9/2003 Bohn, Jr. et al.
6,707,441 B1 3/2004 Hebiguchi et al.
6,958,741 B2 * 10/2005 Tsutsui ..... 345/90
7,129,643 B2 10/2006 Shin et al.
7,215,313 B2 * 5/2007 Giraldo et al. ..... 345/98
(Continued)

FOREIGN PATENT DOCUMENTS

CN 1455914 A 11/2003
CN 1458641 A 11/2003
(Continued)

OTHER PUBLICATIONS

Patent Abstracts of Japan, Publication No. 09-138659, dated May 27, 1997, in the name of Chan-Long Shieh et al.

(Continued)

*Primary Examiner* — Lun-Yi Lao
*Assistant Examiner* — Insa Sadio
(74) *Attorney, Agent, or Firm* — Christie, Parker & Hale, LLP

(57) ABSTRACT

A display device includes a display area having a plurality of data lines, a plurality of first scan lines, a plurality of second and third scan lines, and a plurality of pixel areas. In addition, the display device includes a first driver, a second driver, and a third driver. At least two pixels sharing a data line and a first scan line are formed in at least one of the pixel areas. At least one of the pixels of a first group among the pixels formed in the at least one pixel area is emitted by a first emission signal in a first field, and at least another one of the pixels of a second group are emitted by a second emission signal in a second field.

20 Claims, 12 Drawing Sheets

U.S. PATENT DOCUMENTS

| | | | | |
|---|---|---|---|---|
| 7,256,775 | B2 | 8/2007 | Eom | |
| 2002/0154085 | A1 | 10/2002 | Kim | |
| 2002/0163493 | A1 | 11/2002 | Matsushima et al. | |
| 2003/0107560 | A1 | 6/2003 | Yumoto et al. | |
| 2003/0117352 | A1* | 6/2003 | Kimura | 345/87 |
| 2003/0132931 | A1 | 7/2003 | Kimura et al. | |
| 2003/0189559 | A1* | 10/2003 | Lee et al. | 345/204 |
| 2003/0227262 | A1 | 12/2003 | Kwon | |
| 2004/0217935 | A1 | 11/2004 | Jeon et al. | |
| 2004/0239658 | A1 | 12/2004 | Koyama et al. | |
| 2005/0104823 | A1 | 5/2005 | Giraldo et al. | |
| 2005/0237001 | A1 | 10/2005 | Hayafuji | |
| 2005/0259095 | A1 | 11/2005 | Kwak | |

FOREIGN PATENT DOCUMENTS

| | | | |
|---|---|---|---|
| CN | 1467696 | | 1/2004 |
| CN | 1577442 | | 2/2005 |
| EP | 1 536 406 | A1 | 6/2005 |
| JP | 62-187887 | | 8/1987 |
| JP | 03-085591 | | 4/1991 |
| JP | 04-355789 | | 12/1992 |
| JP | 9-138659 | | 5/1997 |
| JP | 11-038379 | | 2/1999 |
| JP | 2000-347628 | | 12/2000 |
| JP | 2002-244619 | | 8/2002 |
| JP | 2002-268615 | | 9/2002 |
| JP | 2002-352593 | | 12/2002 |
| JP | 2003-022058 | | 1/2003 |
| JP | 2003-510661 | | 3/2003 |
| JP | 2003-101394 | | 4/2003 |
| JP | 2003-108070 | | 4/2003 |
| JP | 2003-122306 | | 4/2003 |
| JP | 2003-140619 | | 5/2003 |
| JP | 2003-141893 | | 5/2003 |
| JP | 2003-216100 | | 7/2003 |
| JP | 2003-255899 | | 9/2003 |
| JP | 2004-004501 | | 1/2004 |
| JP | 2005-49838 | | 2/2005 |
| JP | 2005-520193 | | 7/2005 |
| KR | 2002-0080002 | | 10/2002 |
| WO | WO 96/24123 | | 8/1996 |
| WO | WO 01/24153 | A1 | 4/2001 |
| WO | WO 03/077231 | A3 | 9/2003 |

OTHER PUBLICATIONS

Patent Abstracts of Japan, Publication No. 2002-244619, dated Aug. 30, 2002, in the name of Munenori Ono et al.

Patent Abstracts of Japan, Publication No. 2003-122306, dated Apr. 25, 2003, in the name of Akira Yumoto.

Patent Abstracts of Japan, Publication No. 2005-049838, dated Feb. 24, 2005, in the name of Dong-Yong Shin.

Patent Abstracts of Japan, Publication No. 2002-352593, dated Dec. 6, 2002, in the name of Shin Fujita.

Patent Abstracts of Japan, Publication No. 2003-101394, dated Apr. 4, 2003, in the name of Sho Nagao et al.

Patent Abstracts of Japan, Publication No. 2003-141893, dated May 16, 2003, in the name of Mitsuaki Osame.

European Search Report dated Sep. 6, 2005, for European application 05103853.7.

U.S. Office action dated Oct. 3, 2008, for related U.S. Appl. No. 11/245,324.

U.S. Office action dated Apr. 1, 2009, for related U.S. Appl. No. 11/128,924.

Patent Abstracts of Japan, Publication No. 62-187887, dated Aug. 17, 1987, in the name of Matsushita Electric Industrial Co., Ltd.

Patent Abstracts of Japan, Publication No. 03-085591, dated Apr. 10, 1991, in the name of Takashi Tsukada et al.

Patent Abstracts of Japan, Publication No. 04-355789, dated Dec. 9, 1992, in the name of Etsuji Ozaki.

Patent Abstracts of Japan, Publication No. 2000-347628, dated Dec. 15, 2000, in the name of Minoru Kanbara et al.

Patent Abstracts of Japan, Publication No. 2002-268615, dated Sep. 20, 2002, in the name of Hajimi Kimura.

Patent Abstracts of Japan, Publication No. 2003-022058, dated Jan. 24, 2003, in the name of Katsunori Yamazaki.

Patent Abstracts of Japan, Publication No. 2003-108070, dated Apr. 11, 2003, in the name of Koishi Yamada et al.

Patent Abstracts of Japan, Publication No. 2003-140619, dated May 16, 2003, in the name of Yoshinori Furubayashi et al.

Patent Abstracts of Japan, Publication No. 2003-216100, dated Jul. 30, 2003, in the name of Hiroshi Takahara.

Patent Abstracts of Japan, Publication No. 2003-255899, dated Sep. 10, 2003, in the name of Hiroshi Tsuchiya et al.

Patent Abstracts of Japan, Publication No. 11-038379, dated Feb. 12, 1999, in the name of Chiharu Haniyuda.

Office Action dated Nov. 10, 2010 of related U.S. Appl. No. 11/128,924.

U.S. Office action dated Jul. 7, 2010, for cross reference U.S. Appl. No. 11/128,924, 22 pages.

* cited by examiner

DISPLAY, AND DISPLAY PANEL AND DRIVING METHOD THEREOF

CROSS REFERENCE TO RELATED APPLICATION

This application claims priority to and the benefit of Korean Patent Application No. 10-2004-0037288, filed on May 25, 2004 in the Korean Intellectual Property Office, the entire content of which is incorporated herein by reference.

BACKGROUND OF THE INVENTION

1. Field of the Invention

The present invention relates to a display device, and more particularly, to an organic light emitting diode display and driving method thereof.

2. Discussion of the Related Art

Conventionally, an organic light emitting diode (OLED) display is a device in which lights are emitted by exciting phosphorus organic compounds, and represents images by voltage-programming or current-programming n×m number of organic emission pixels. The organic emission pixels include an anode, an organic thin film layer, and a cathode. The organic thin film layer has a multi-layer formation that includes an emitting layer (EML), an electron transport layer (ETL), and a hole transport layer (HTL) for the purpose of balancing electrons and holes, and increasing the emission factor. In addition, the organic thin film layer includes an electron injecting layer (EIL) and a hole injecting layer (HIL).

The organic emission pixels can be driven by a passive matrix method or an active matrix method. The active matrix method uses thin film transistors (TFTs) to drive the organic emission pixels. In the passive matrix method, an anode and a cathode are formed to cross (or to cross over) each other, and a line is selected in order to drive an organic emission pixel. By contrast, in the active matrix method, a TFT is coupled to an indium tin oxide (ITO) pixel electrode (or an anode), and an organic emission pixel operates according to a voltage maintained by the capacitance of a capacitor coupled to a gate of the TFT. The active matrix method can be further divided into a voltage programming method and a current programming method according to a signal which is applied in order to program a voltage to the capacitor.

The organic EL display requires a scan driver for driving a scan line and a data driver for driving a data line. Output terminals corresponding to the number of data lines are required because the data driver converts digital signals to analog signals and applies them to the data lines. However, the data driver conventionally includes a plurality of integrated circuits, the number of output terminals of the integrated circuits is limited, and therefore many integrated circuits have to be problematically used for the purpose of driving the data lines.

Also, it has been problematic that aperture efficiency of pixels is reduced because the conventional organic EL display must include driving circuits for driving the pixels and the data lines for respective red, green, and blue pixels in a limited display area.

SUMMARY OF THE INVENTION

An aspect of the present invention provides a display that reduces the number of integrated circuits for driving data lines.

More specifically, an aspect of the present invention provides a display that increases an aperture efficiency by reducing the number of driving circuits for driving data lines and pixels.

One exemplary embodiment of the present invention provides a display device having: a display area including a plurality of data lines for transmitting data signals for displaying an image, a plurality of first scan lines for transmitting selection signals, a plurality of second and third scan lines for respectively transmitting first and second emission signals, and a plurality of pixel areas respectively defined by the data lines and the first scan lines; a first driver for sequentially transmitting the respective selection signals to the first scan lines in a plurality of fields forming a frame; a second driver for sequentially transmitting the first emission signals to the second scan lines in a first field of the plurality of fields; and a third driver for sequentially transmitting the second emission signals to the third scan lines in a second field of the plurality of fields. At least two pixels sharing one of the data lines and one of the first scan lines are formed in at least one of the pixel areas. At least one of the pixels formed in the at least one pixel area is emitted by at least one of the first emission signals in the first field, and at least another one of the pixels formed in the at least one pixel area is emitted by at least one of the second emission signals in the second field.

One exemplary embodiment of the present invention provides a display device having: a display area including a plurality of data lines for transmitting data signals for displaying an image, a plurality of first scan lines for transmitting selection signals, a plurality of second scan lines for transmitting emission signals having first and second level voltages, and a plurality of pixel areas respectively defined by the data lines and the first scan lines; a first driver for sequentially transmitting the respective selection signals to the plurality of first scan lines in a plurality of fields forming a frame; and a second driver for sequentially transmitting the emission signals having the first level voltage to the plurality of second scan lines in a first field of the plurality of fields and transmitting the emission signals having the second level voltage to the plurality of second scan lines in a second field of the plurality of fields. At least two pixels sharing one of the data lines and one of the first scan lines are formed in at least one of the pixel areas. At least one of the pixels formed in the at least one pixel area belongs to a first group and is emitted by the emission signals having the first level voltage in the first field. At least another one of the pixels formed in the at least one pixel area belongs to a second group and is emitted by the signals having the second level voltage in the second field.

One exemplary embodiment of the present invention provides a display device having: a plurality of data lines for transmitting data signals displaying an image; a plurality of first scan lines for transmitting respective selection signals in a first field and a second field; a plurality of second scan lines for transmitting first emission signals in the first field; a plurality of third scan lines for transmitting second emission signals in the second field; and at least one of a plurality of pixel areas defined by one of the data lines and one of the first scan lines. A first pixel and a second pixel sharing the one data line and the one first scan line are formed in the at least one pixel area. The first pixel in the at least one pixel area defined by the one first scan line belongs to a first group of the plurality of first scan lines and is emitted by at least one of the first emission signals, and the second pixel in the at least one pixel area is emitted by at least one of the second emission signals. A first pixel of at least another one of the pixel areas defined by another one of the first scan lines belongs to a second group of the plurality of first scan lines and is emitted by the at least one of the second emission signals, and a second pixel in the at least another one of the pixel area is emitted by at least one of the first emission signals.

One exemplary embodiment of the present invention provides a display device having: a plurality of data lines for transmitting data signals for displaying an image; a plurality of first scan lines for transmitting respective selection signals in a first field and a second field; a plurality of second scan lines for transmitting a first level emission signal in the first field and a second level emission signal in the second field; and a plurality of pixel areas defined by one of the data lines and one of the first scan lines. A first pixel and a second pixel sharing the one data line and the one first scan line are formed in each of the pixel area. The first pixel is emitted by the first level emission signal and the second pixel is emitted by the second level emission signal, and the first pixel and the second pixel are differently placed a first group and a second group of the plurality of pixel areas.

One exemplary of the present invention provides a method for driving a display device having a plurality of data lines for transmitting data signals for displaying an image, a plurality of first scan lines for transmitting selection signals, and a plurality of pixel areas defined by the data line and the first scan line. At least two pixels sharing one of the data lines and one of the scan lines are respectively formed in each of a subset of the plurality of pixel areas and belong to a first group or a second group. In the method, 1) selection signals are sequentially applied to the plurality of first scan lines in a first field; 2) at least one of the data signals corresponding to the first group is programmed onto the plurality of data lines; 3) emission signals are applied to each pixel of the first group to emit each pixel of the first group; 4) the selection signals are sequentially applied to the plurality of first scan lines in a second field; 5) at least another one of the data signals corresponding the second group is programmed onto the plurality of data lines; and 6) the emission signals are applied to each pixel of the second group to emit each pixel of the second group. The pixels of the first and the second group are established to have at least one non-emitting pixel between neighboring emitting pixels in the first and the second field.

It is to be understood that both the foregoing general description and the following detailed description are exemplary and explanatory and are intended to provide further explanation of the invention as claimed.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
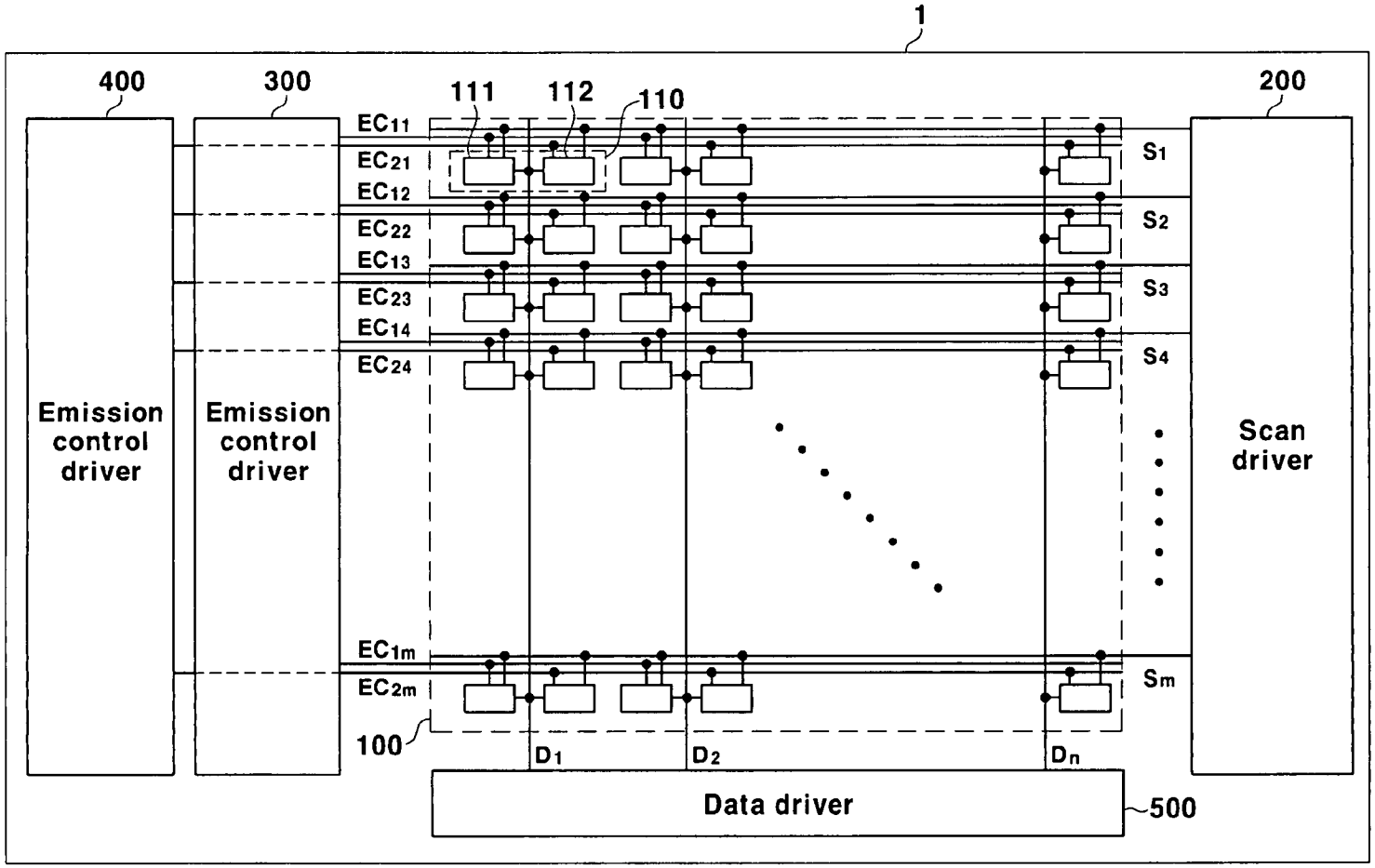
FIG. 1 shows a schematic diagram for representing an organic EL display according to a first exemplary embodiment of the present invention.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

There may be parts shown in the drawings, or parts not shown in the drawings, that are not discussed in the specification as they are not essential to a complete understanding of the invention. Like reference numerals designate like elements.

An organic light emitting diode (hereinafter, also referred to as "OLED") display using light emitting materials and according to a first exemplary embodiment of the present invention will now be described below with reference to FIG. 1.

As shown in FIG. 1, the organic EL display according to the first exemplary embodiment of the present invention includes a substrate 1 for forming a display panel. The substrate 1 includes a display area 100 for substantially displaying images and a neighboring area which displays no image. A scan driver 200, emission control drivers 300 and 400, and a data driver 500 are provided in the neighboring area around the display area 100.

A plurality of data lines $D_1$ to $D_n$, a plurality of selection scan lines $S_1$ to $S_m$, a plurality of emission scan lines $EC_{11}$ to $EC_{1m}$ and $EC_{21}$ to $EC_{2m}$, and a plurality of pixels (e.g., pixels 111 and 112) are provided in the display area 100. The data lines $D_1$ to $D_n$ extend in a column direction and transmit data signals for displaying an image to the pixels. The selection scan lines $S_1$ to $S_m$ and the emission scan lines $EC_{11}$ to $EC_{1m}$ and $EC_{21}$ to $EC_{2m}$ extend in a row direction, and respectively transmit selection signals and emission signals to the pixels. A pixel area 110 is formed by a data line (e.g., $D_1$) and a selection scan line (e.g., $S_1$), and two pixels (or two pixel circuits) 111 and 112 are formed in the pixel area 110.

The scan driver 200 applies the selection signals to the selection scan lines $S_1$ to $S_m$ in sequence, and the emission control drivers 300 and 400 respectively apply the emission signals to the emission scan lines $EC_{11}$ to $EC_{1m}$ and $EC_{21}$ to $EC_{2m}$ in sequence. Also, the data driver 500 applies the data signals to the data lines $D_1$ to $D_n$.

According to the first exemplary embodiment of the present invention, the drivers 200 to 400 divide a frame into two fields to thus drive the respective scan lines $S_1$ to $S_m$, $EC_{11}$ to $EC_{1m}$, and $EC_{21}$ to $EC_{2m}$. That is, the scan driver 200 sequentially applies the selection signals to the selection scan lines $S_1$ to $S_m$ in the respective fields, the emission control driver 300 sequentially applies the emission signals to the emission scan lines $EC_{11}$ to $EC_{1m}$ in one of the fields, and the emission control driver 400 sequentially applies the emission signals to the emission scan lines $EC_{21}$ to $EC_{2m}$ in another one of the fields.

The respective drivers 200 to 400 and/or the data driver 500 may be directly provided on the substrate 1 as an integrated circuit type. Alternatively, the drivers 200 to 400 and/or 500 may be formed corresponding to layers which form transistors of the scan lines $S_1$ to $S_m$, $EC_{11}$ to $EC_{1m}$, and $EC_{21}$ to $EC_{2m}$, the data lines $D_1$ to $D_n$, and the pixel circuits (e.g., the pixel circuits 111 and 112). Alternatively, the drivers 200 to 400 and/or 500 may be formed on an additional substrate and that substrate may be coupled to the substrate 1, or they may be provided as a chip-type to a tape carrier package (TCP), a flexible printed circuit (FPC), or a tape automatic bonding (TAB) which are coupled to the substrate 1.

Pixels according to the first exemplary embodiment of the present invention will now be described with reference to FIG. 2.

Figure 2:
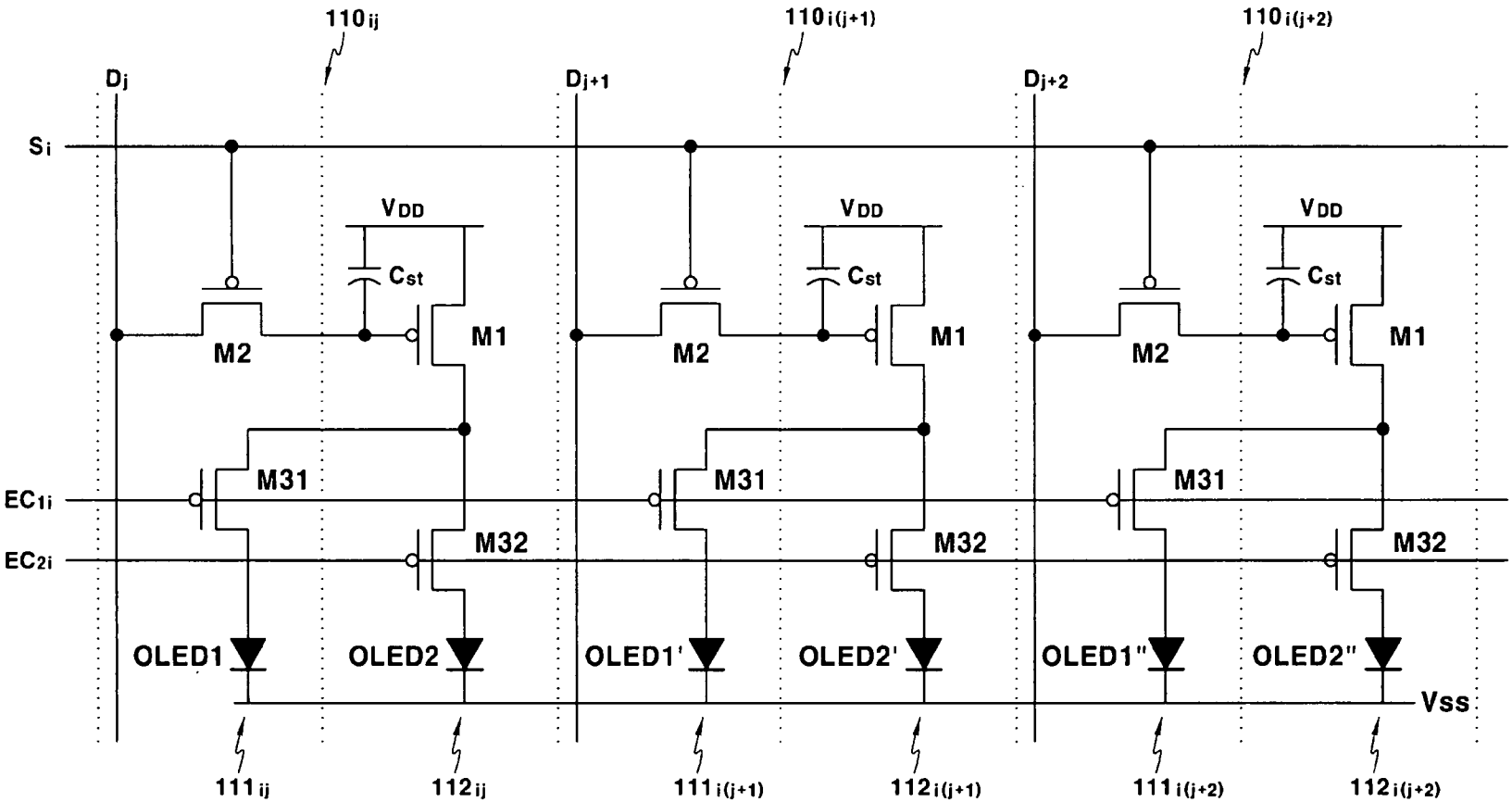
FIG. 2 shows a schematic circuit diagram of pixels (or pixel circuits) according to the first exemplary embodiment of the present invention.

FIG. 2 shows a schematic circuit diagram of the pixels according to the first exemplary embodiment of the present invention. In FIG. 2, for convenience of description, six pixels $\mathbf{111}_{ij}$, $\mathbf{112}_{ij}$, $\mathbf{111}_{i(j+1)}$, $\mathbf{112}_{i(j+1)}$, $\mathbf{111}_{i(j+2)}$, and $\mathbf{112}_{i(j+2)}$ are represented, which are formed in three pixel areas $\mathbf{110}_{ij}$, $\mathbf{110}_{i(j+1)}$, and $\mathbf{110}_{i(j+2)}$ respectively formed on a scan line $S_i$ of the $i^{th}$ row and data lines $D_i$, $D_{j+1}$, and $D_{j+2}$ of the columns from $j^{th}$ to $(j+2)^{th}$ (herein, i denotes an integer from 1 to m, and j denotes an integer from 1 to (n−2)). Also, it is assumed that the pixels are arranged in an order of red, green, and blue in a row direction in FIG. 2.

As shown in FIG. 2, the pixel area $\mathbf{110}_{ij}$ is formed by the selection scan line $S_i$ and the data line $D_j$, and includes the two pixels $\mathbf{111}_{ij}$ and $\mathbf{112}_{ij}$. The pixels $\mathbf{111}_{ij}$ and $\mathbf{112}_{ij}$ share a driving circuit and the data line $D_j$, and respectively include switching transistors M31 and M32 and organic light-emitting (LE) diodes OLED1 and OLED2. The organic LE diodes OLED1 and OLED2 emit lights of red and green.

The pixel area $\mathbf{110}_{i(j+1)}$ is formed by the selection scan line $S_i$ and the data line $D_{j+1}$, and includes the two pixels $\mathbf{111}_{i(j+1)}$ and $\mathbf{112}_{i(j+1)}$. The pixels $\mathbf{111}_{i(j+1)}$ and $\mathbf{112}_{i(j+1)}$ of the pixel area $\mathbf{110}_{i(j+1)}$ have a configuration substantially corresponding to the pixels $\mathbf{111}_{ij}$ and $\mathbf{112}_{ij}$, with the exception that the organic LE diodes OLED1' and OLED2' of the pixels $\mathbf{111}_{i(j+1)}$ and $\mathbf{112}_{i(j+1)}$ emit lights of blue and red.

The pixel area $\mathbf{110}_{i(j+2)}$ is formed by the selection scan line $S_i$ and the data line $D_{j+2}$, and includes the two pixels $\mathbf{111}_{i(j+2)}$ and $\mathbf{112}_{i(j+2)}$. The pixels $\mathbf{111}_{i(j+2)}$ and $\mathbf{112}_{i(j+2)}$ of the pixel area $\mathbf{110}_{i(j+2)}$ have a configuration corresponding to the pixels $\mathbf{111}_{ij}$ and $\mathbf{112}_{ij}$, with the exception that the organic LE diodes OLED1" and OLED2" of the pixels $\mathbf{111}_{i(j+2)}$ and $\mathbf{112}_{i(j+2)}$ emit lights of green and blue.

In more detail and according to the first exemplary embodiment of the present invention, the pixel areas $\mathbf{110}_{ij}$, $\mathbf{110}_{i(j+1)}$, and $\mathbf{110}_{i(j+2)}$ are substantially the same. As such, only the driving circuit of the pixel area $\mathbf{110}_{ij}$ will be described below by way of an example. The driving circuit of the pixel area $\mathbf{110}_{ij}$ includes a driving transistor M1, a switching transistor M2, and a capacitor Cst. The capacitor Cst stores a voltage corresponding to a data signal programmed through the switching transistor M2, and the driving transistor M1 conducts currents from a power voltage VDD by the voltage stored in the capacitor Cst.

A source of the transistor M1 is coupled to the power voltage VDD, and the capacitor Cst is coupled between the source and a gate of the transistor M1. Also, the transistor M2 is coupled between the gate of the transistor M1 and the data lines $D_j$, $D_{j+1}$, and $D_{j+2}$, and transmits the data signal to the gate of the transistor M1 by responding to the selection signal applied to the gate of transistor M2.

The transistors M31 and M32 are respectively coupled to a drain of the transistor M1 and the organic LE diodes OLED1 and OLED2, and transmit output currents of the transistor M1 to the organic LE diodes OLED1 and OLED2 by responding to the emission signals from the emission scan lines $EC_{1i}$ and $EC_{2i}$. A cathode of the organic LE diode OLED1 and/or OLED 2 is coupled to a power voltage VSS, the power voltage VSS is less than the power voltage VDD. A negative voltage or a ground voltage can be used for the power voltage VSS.

In operation, a low-level selection signal is applied to the selection scan line $S_i$, a data voltage is transmitted to the gate of the transistor M1 through the transistor M2, and a voltage $V_{SG}$ corresponding to a difference between the power voltage VDD and the data voltage is applied between the gate and the source of the transistor M1. Also, the voltage of $V_{SG}$ is charged to the capacitor $C_{st}$.

A low-level emission signal is then applied to the emission scan line $EC_{1i}$, the transistor M31 is turned on, and a current $I_{OLED}$, as will be shown in Equation 1, is supplied to the organic LE diode OLED1 from the transistor M1. Therefore, the organic LE diode OLED1 emits light corresponding to the intensity of the current $I_{OLED}$. In a like manner, a low-level emission signal is applied to the emission scan line $EC_{2i}$, the transistor M32 is turned on, and the organic LE diode OLED2 emits light. That is, the organic LE diodes OLED1 and OLED2 are emitted respectively at once in two fields of a frame, and a color is displayed.

$$I_{OLED}=\beta/2(|V_{SG}|-|V_{TH}|)^2 \quad \text{[Equation 1]}$$

where β denotes a constant, $V_{SG}$ denotes a source-gate voltage at the transistor M1, and $V_{TH}$ denotes a threshold voltage at the transistor M1.

A method for driving the organic EL display according to the first exemplary embodiment of the present invention will now be described with reference to FIG. 3 to FIG. 4B.

Figure 3:
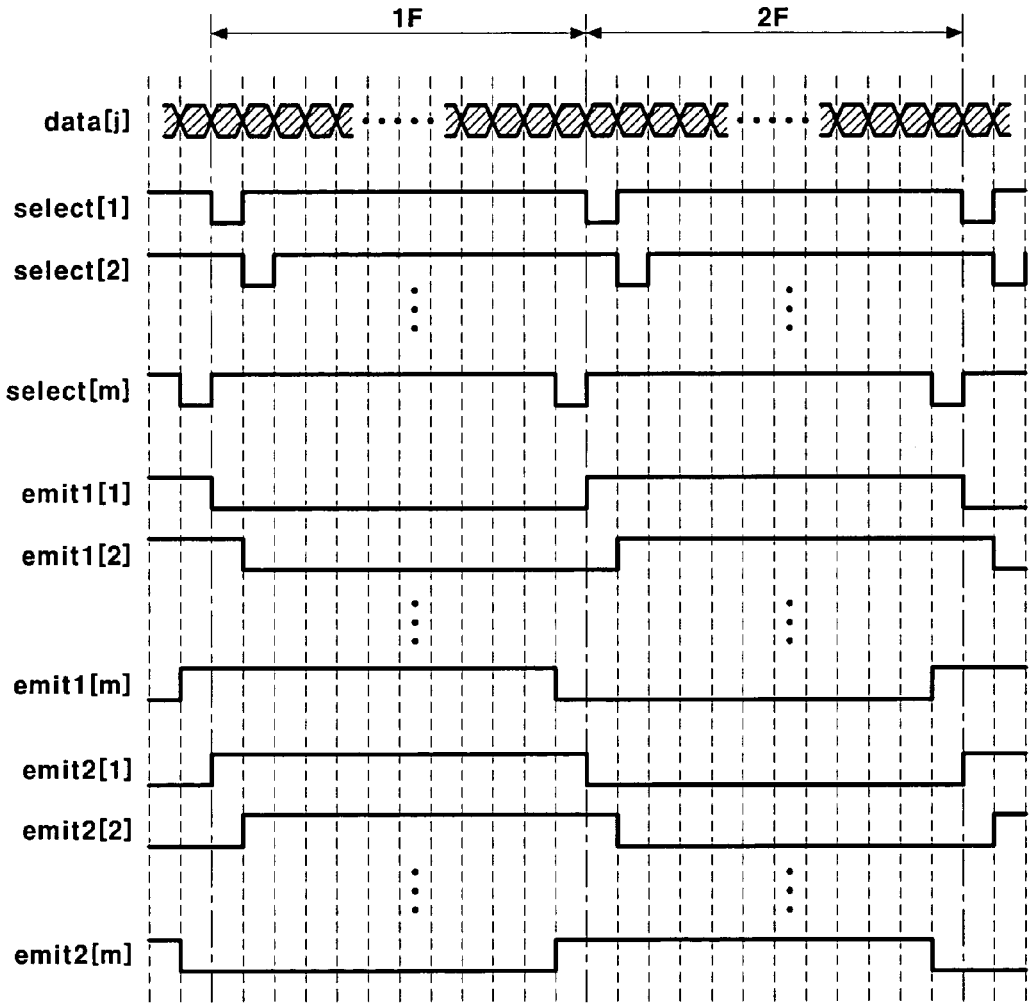
FIG. 3 shows a driving timing chart for the organic EL display according to the first exemplary embodiment of the present invention.
Figure 4A:
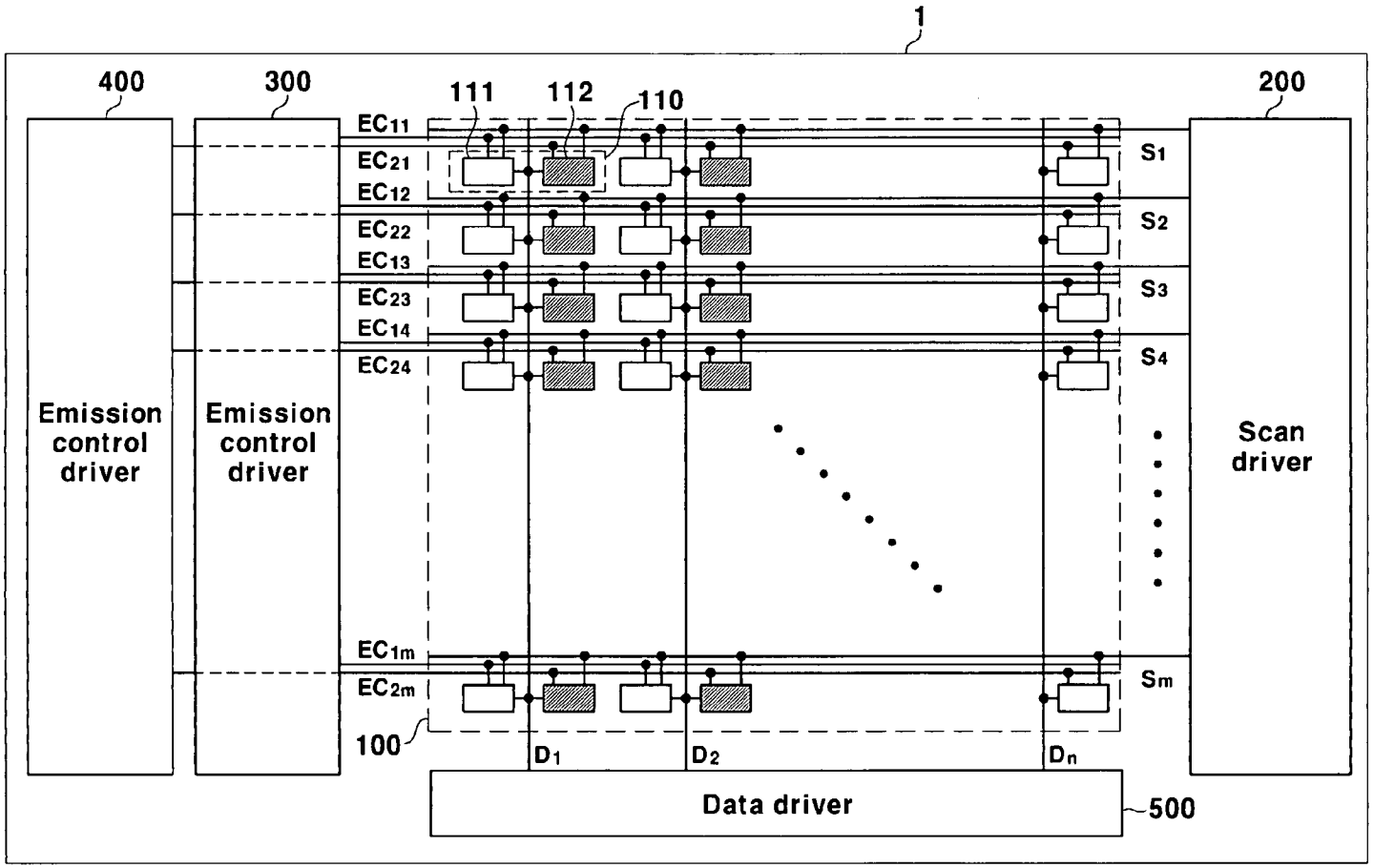
FIGS. 4A and 4B respectively show diagrams for representing pixel lighting in a first field and a second field of the organic EL display according to the first exemplary embodiment of the present invention.
Figure 4B:
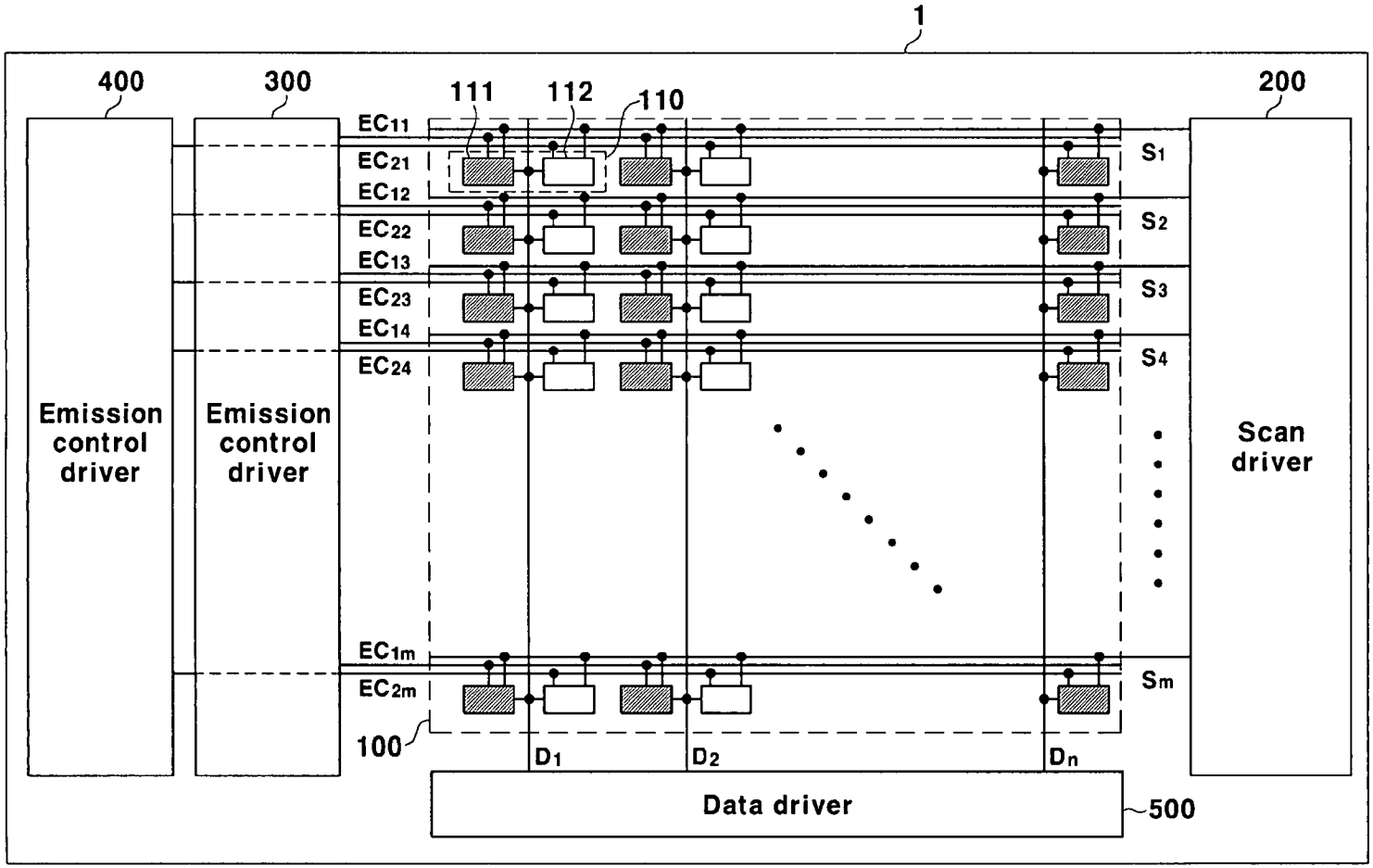

FIG. 3 shows a driving timing chart for the organic EL display according to the first exemplary embodiment of the present invention, and FIGS. 4A and 4B respectively show diagrams for representing pixel lightings in a first field and a second field.

A selection signal applied to the selection scan line $S_i$ is represented as select[i], and emission signals applied to the emission scan lines $EC_{1i}$ and $EC_{2i}$ are respectively represented as emit1[i] and emit2[i] (herein, i denotes an integer from 1 to m). Only a data voltage applied to the $j^{th}$ data line $D_j$ is represented as data[j] in FIG. 3 because data voltages are applied to the data lines $D_1$ to $D_n$ at the same time.

As shown in FIG. 3, a frame is divided into two fields 1F and 2F in order to drive the organic EL display according to the first exemplary embodiment of the present invention, and low-level selection signals select[1] to select[m] are sequentially applied to the selection scan lines $S_1$ to $S_m$ in the fields 1F and 2F. The organic LE diodes OLED1 and OLED2 (or OLED1' and OLED2' or OLED1" and OLED2") of two pixels (e.g. pixels $\mathbf{111}_{ij}$ and $\mathbf{112}_{ij}$) sharing the driving circuit are respectively emitted for a period corresponding to a field. The fields 1F and 2F are separately defined for each row, and are illustrated based on a first row selection scan line $S_1$ in FIG. 3.

In the first field 1F, the selection signal applied to the selection scan line $S_1$ becomes a low-level pulse, and the data voltage data[j] corresponding to the organic LE diode OLED1, OLED1', or OLED1" which is included in each pixel area of a first row is transmitted to the data line $D_j$. The emission signal emit1[1] of the emission scan line $EC_{11}$ becomes the low-level pulse, and the transistor M31 is turned on. A current corresponding to the data voltage data[j] in the pixel area of the first row is output to the drain of the transistor M1, and the transistor M31 transmits the output current of the transistor M1 to the organic LE diode OLED1, OLED1', or OLED1". Therefore, the organic LE diode OLED1, OLED1', or OLED1" is emitted corresponding to the current applied to the organic LE diode OLED1, OLED1', or OLED1", and the emission of the organic LE diode OLED1, OLED1', or OLED1" is maintained while the emission signal emit1[1] is maintained at the low level. According to the first exemplary embodiment of the present invention, a width of the low-level pulse of the emission signal emit1[1] substantially corresponds to a period of the first field 1F.

The selection signal select[2] of the selection scan line $S_2$ becomes the low-level pulse, and the data voltage data[j] corresponding to the organic LE diode OLED1, OLED1', or OLED1" in each pixel area of a second row is applied to the data line $D_j$. The emission signal emit1[2] of the emission scan line $EC_{12}$ becomes the low-level pulse, and the transistor M31 is turned on. As such, the organic LE diode OLED1, OLED1', or OLED1" in the pixel area of the second row is emitted while the emission signal emit1[2] is maintained at the low level.

In a like manner, the selection signals select[1] to select[m] which have the low-level pulses are sequentially applied to the selection scan lines $S_1$ to $S_m$ from the first row and the $m^{th}$ row. The data voltage data[j] corresponding to the organic LE diode OLED1, OLED1', or OLED1" of each pixel area is applied to the data line $D_j$ while the selection signal select[i] of selection scan line $S_i$ in the $i^{th}$ row is maintained at the low-level pulse. The emission signal emit1[i] of the emission scan line $EC_{1i}$ among the two emission scan lines $EC_{1i}$ and $EC_{2i}$ of the $i^{th}$ row becomes the low level pulse when the selection signal select[i] of the selection scan line $S_i$ becomes the low level pulse, and the width of the low level pulse of the emission signal emit1[i] corresponds to the period of the first field 1F. In each row, the selection signal select[i] of the selection scan line $S_i$ becomes the low level pulse, and the organic LE diode OLED1, OLED1', or OLED1" is emitted for a period corresponding to the first field 1F.

That is, according to the first exemplary embodiment of the present invention, the organic LE diodes OLED1*s*, OLED1'*s*, or OLED1"*s* of the respective rows are emitted in the first field, and therefore, as shown in FIG. 4A, the pixel (e.g., the pixel 111) formed in the left side of the data line (e.g., the data line $D_1$) among the two pixels (e.g., the pixels 111 and 112) sharing the data line and neighboring in the row direction are emitted.

In the second field 2F, the selection signal select[1] of the selection scan line $S_1$ becomes the low level pulse, and the data voltage data[j] corresponding to the organic LE diode OLED2, OLED2', or OLED2" in each pixel area of the first row is applied to the data line $D_j$. The emission signal emit2[1] of the emission scan line $EC_{21}$ becomes the low level pulse, and the transistor M32 is turned on. The organic LE diode OLED2, OLED2', or OLED2" is emitted, and the emission of the organic LE diode OLED2, OLED2', or OLED2" is maintained while the emission signal emit2[1] is maintained at the low level pulse. According to the first exemplary embodiment of the present invention, the width of the low level pulse of the emission signal emit2[1] substantially corresponds to a period of the second field.

When the selection signal select[2] of the selection scan line $S_2$ becomes the low level pulse, the data voltage data[j] corresponding to the organic LE diode OLED2, OLED2', or OLED2" in each pixel area of the second row is applied to the data line $D_j$, the emission signal emit2[2] of the emission scan line $EC_{22}$ in the second row becomes the low level pulse, and the transistor M32 is turned on. The organic LE diode OLED2, OLED2', or OLED2" in the pixel area of the second row is emitted while the emission signal emit2[2] is maintained at the low level pulse.

In a like manner, the selection signals select[1] to select[m] of the selection scan lines $S_1$ to $S_m$ from the first row and the $m^{th}$ row sequentially become the low level pulses in the second field 2F. The data voltage data[j] corresponding to the organic LE diode OLED2, OLED2', or OLED2" in each pixel area is applied to the data line $D_j$ while the selection signal select[i] of the selection scan line $S_i$ of the $i^{th}$ row is the low level pulse. The emission signal emit2[i] of the emission scan line $EC_{2i}$ among the two emission scan lines $EC_{1i}$ and $EC_{2i}$ of the $i^{th}$ row becomes the low level pulse when the selection signal select[i] of the selection scan line $S_i$ becomes the low level pulse, and the width of the low level pulse of the emission signal emit2[i] corresponds to the period of the second field 2F. In each row, the selection signal select[i] of the selection scan line $S_i$ becomes the low level pulse, and the organic LE diode OLED2, OLED2', or OLED2" is emitted for a period corresponding to the second field 2F.

That is, according to the first exemplary embodiment of the present invention, the organic LE diodes OLED2*s*, OLED2'*s*, or OLED2"*s* of the respective rows are emitted in the second field, and the pixel (e.g., the pixel 112) formed in the right side of the data line (e.g., the data line $D_1$) among the two pixels (e.g., the pixels 111 and 112) sharing the data line and neighboring in the row direction are emitted.

As such, a frame is divided into two fields in order to drive the organic EL display according to the first exemplary embodiment of the present invention, and the organic LE diode of a pixel among two pixels in each pixel area is emitted in a field. The organic LE diode of the other pixel among two pixels in each pixel area is emitted in the other field, and therefore the organic LE diodes of pixels are emitted in a frame and every color is represented.

Also, in the first exemplary embodiment of the present invention, the number of the driving circuits and the data lines is reduced to half of the prior art because two pixels share a driving circuit and a data line. Therefore, the number of the integrated circuits for driving a data line (e.g., the data line $D_j$) is reduced, and the arrangement of elements in a pixel area is also simplified.

However, when pixels of the same row in respective fields are emitted in the like manner of the first exemplary embodiment of the present invention, patterns of pixels which emit no light in the respective fields are displayed for a short time on the display panel. That is, each pixel (e.g., the organic LE diode OLED1, OLED1', or OLED1") which is formed in a left side among two pixels of a pixel area sharing a data line and neighboring in a row direction is emitted in the first field of a frame, each pixel (e.g., the organic LE diode OLED2, OLED2', or OLED2") which is formed in a right side of the data line is emitted in the second field of the frame, and therefore, a vertical stripe is displayed on the panel because the pixels in a row are emitted on or off at the same time when the emission is processed from the first field to the second field.

Therefore, a second exemplary embodiment of the present invention establishes at least one non-emitting pixel to be provided between the emitting pixels neighboring each other in up and down directions, and right and left directions, and eliminates the vertical stripe on the panel.

Figure 5:
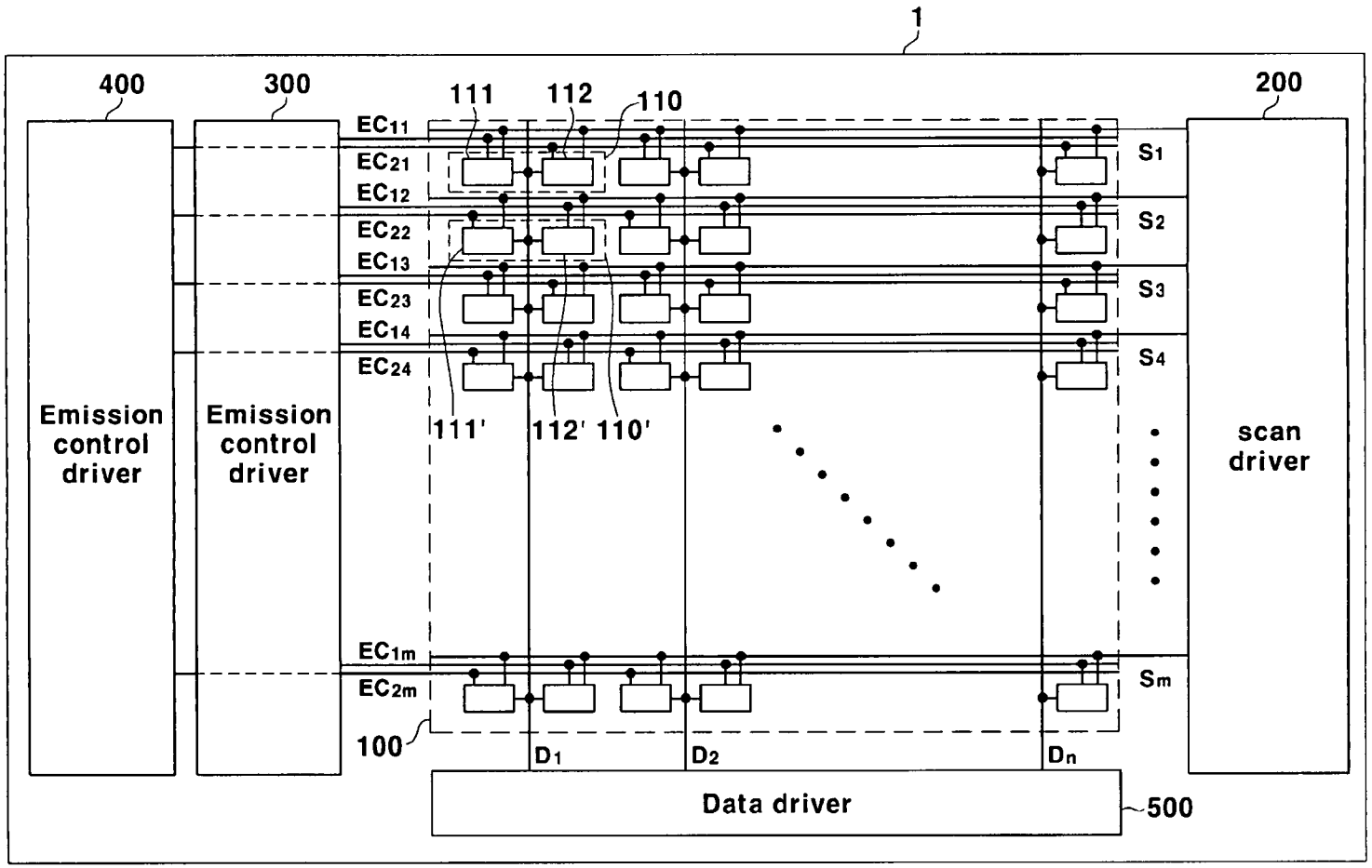
FIG. 5 shows a schematic diagram for representing a display according to a second exemplary embodiment of the present invention.

A display according to the second exemplary embodiment of the present invention will now be described with reference to FIG. 5 to FIG. 6B. FIG. 5 shows a schematic diagram for representing the display according to the second exemplary embodiment of the present invention, and FIGS. 6A and 6B respectively shows diagrams for representing pixel lightings in a first and a second field.

The display according to the second exemplary embodiment of the present invention differs from the display according to the first exemplary embodiment of the present invention because a connection of the odd row emission scan lines $EC_{1(2i-1)}$ and $EC_{2(2i-1)}$ and a connection of the even row emission scan lines $EC_{1(2i)}$ and $EC_{2(2i)}$ are changed.

That is, in a first row, the emission scan line $EC_{11}$ is coupled to a left pixel 111 and the emission scan line $EC_{21}$ is coupled to a right pixel 112 in the pixel area 110. In a second row, the emission scan line $EC_{12}$ is coupled to a right pixel 112' and the emission scan line $EC_{22}$ is coupled to a left pixel 111' in a pixel area 110'.

According to the second exemplary embodiment of the present invention, the emission scan line $EC_{1(2i-1)}$ is coupled to the left pixels 111 and the emission scan line $EC_{2(2i-1)}$ is coupled to the right pixels 112 in the odd rows, and the emission scan line $EC_{1(2i)}$ is coupled to the right pixels 112' and the emission scan line $EC_{2(2i)}$ is coupled to the left pixels 111' in the even rows.

Figure 6A:
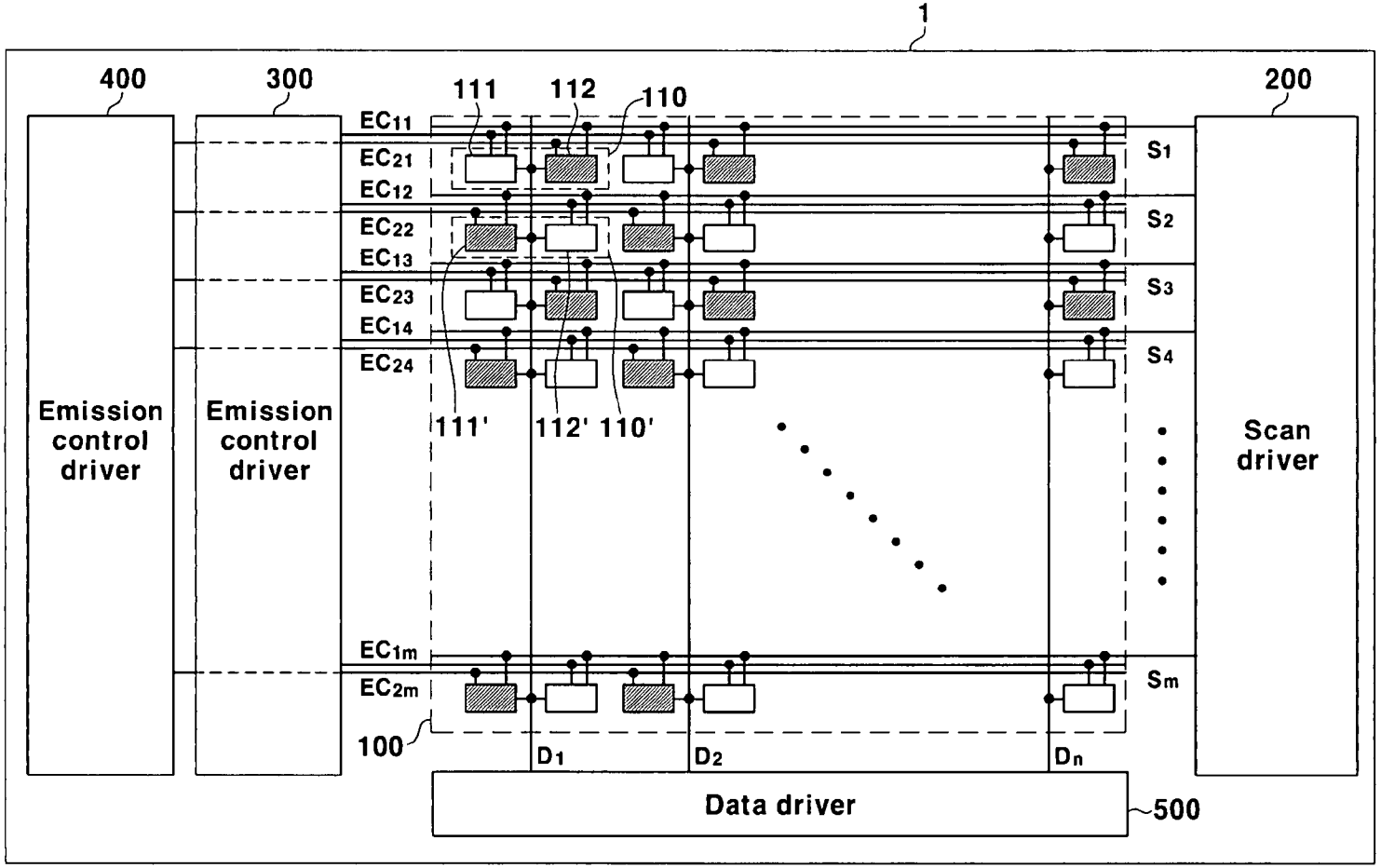
FIGS. 6A and 6B respectively show diagrams for representing pixel lightings in a first and a second field of the display according to the second exemplary embodiment of the present invention.
Figure 6B:
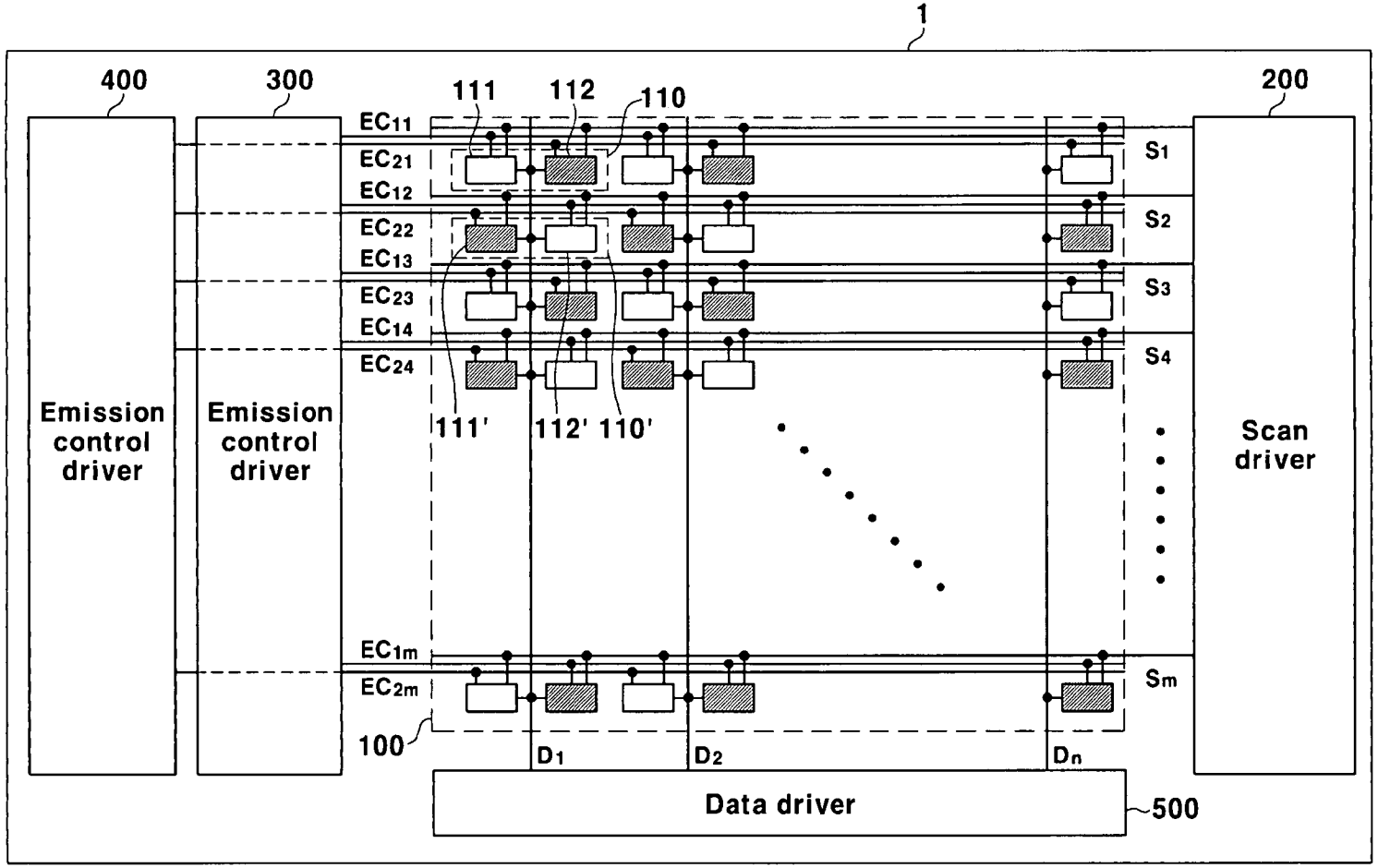

As such, as shown in FIG. 6A, the left pixel 111 in the pixel area 110 of the odd row and the right pixel 112' in the pixel area 110' of the even row are emitted in the first field 1F. As shown in FIG. 6B, the right pixel 112 in the pixel area 110 of the odd row and the left pixel 111' in the pixel area 110' of the even row are emitted in the second field 2F.

Therefore, at least one non-emitting pixel is provided between two emitting pixels neighboring each other in an up and down direction, or in a right and left direction, and therefore pixels in the same row and column are not lighted on/off at the same time. The vertical stripe generated on the display panel is eliminated and a definition of a display is improved.

Figure 7A:
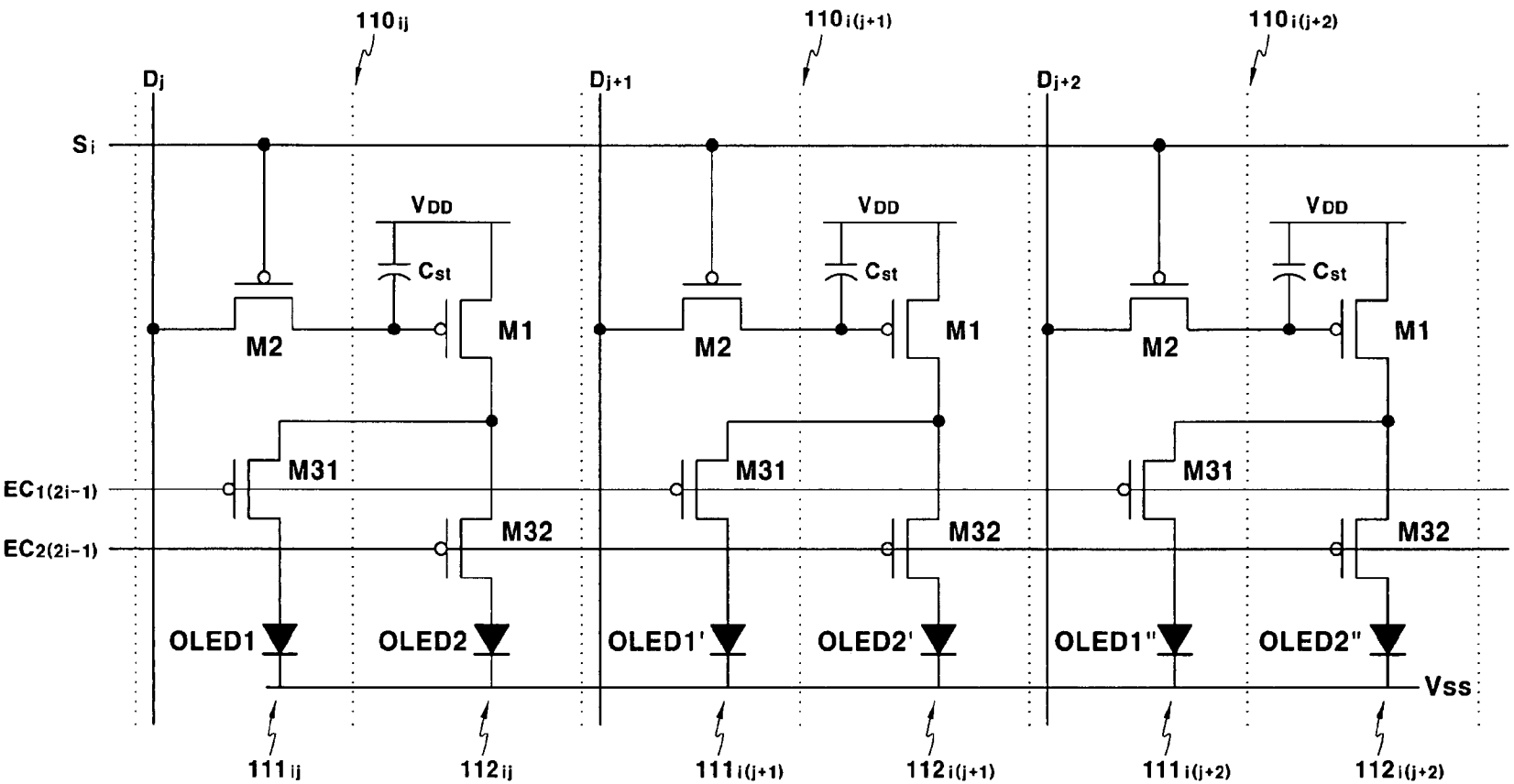
FIG. 7A shows a diagram for representing six pixels in a pixel area of an odd row according to the second exemplary embodiment of the present invention.

Pixels according to the second exemplary embodiment of the present invention will now be described with reference to FIGS. 7A and 7B. FIG. 7A shows a diagram for representing six pixels in the pixel area of the odd row, and FIG. 7B shows a diagram for representing six pixels in the pixel area of the even row.

As shown in FIG. 7A, gates of the transistors M31 of the left pixels $\mathbf{111}_{ij}$, $\mathbf{111}_{i(j+1)}$, $\mathbf{111}_{i(j+2)}$ among the pixels in the pixel area $\mathbf{110}_{ij}$, $\mathbf{110}_{i(j+1)}$, $\mathbf{110}_{i(j+2)}$ of the odd row are coupled to the emission scan line $EC_{1(2i-1)}$, and gates of the transistors M32 of the right pixels $\mathbf{112}_{ij}$, $\mathbf{112}_{i(j+1)}$, $\mathbf{112}_{i(j+2)}$ are coupled to the emission scan line $EC_{2(2i-1)}$.

Accordingly, the left pixels in the pixel areas 110 of the odd rows are emitted when the emission signals are sequentially applied to the emission scan lines $EC_{11}$ to $EC_{1m}$ in the first field, and the right pixels in the pixel areas 110 of the odd rows are emitted when the emission signals are sequentially applied to the emission scan lines $EC_{21}$ to $EC_{2m}$ in the second field.

Figure 7B:
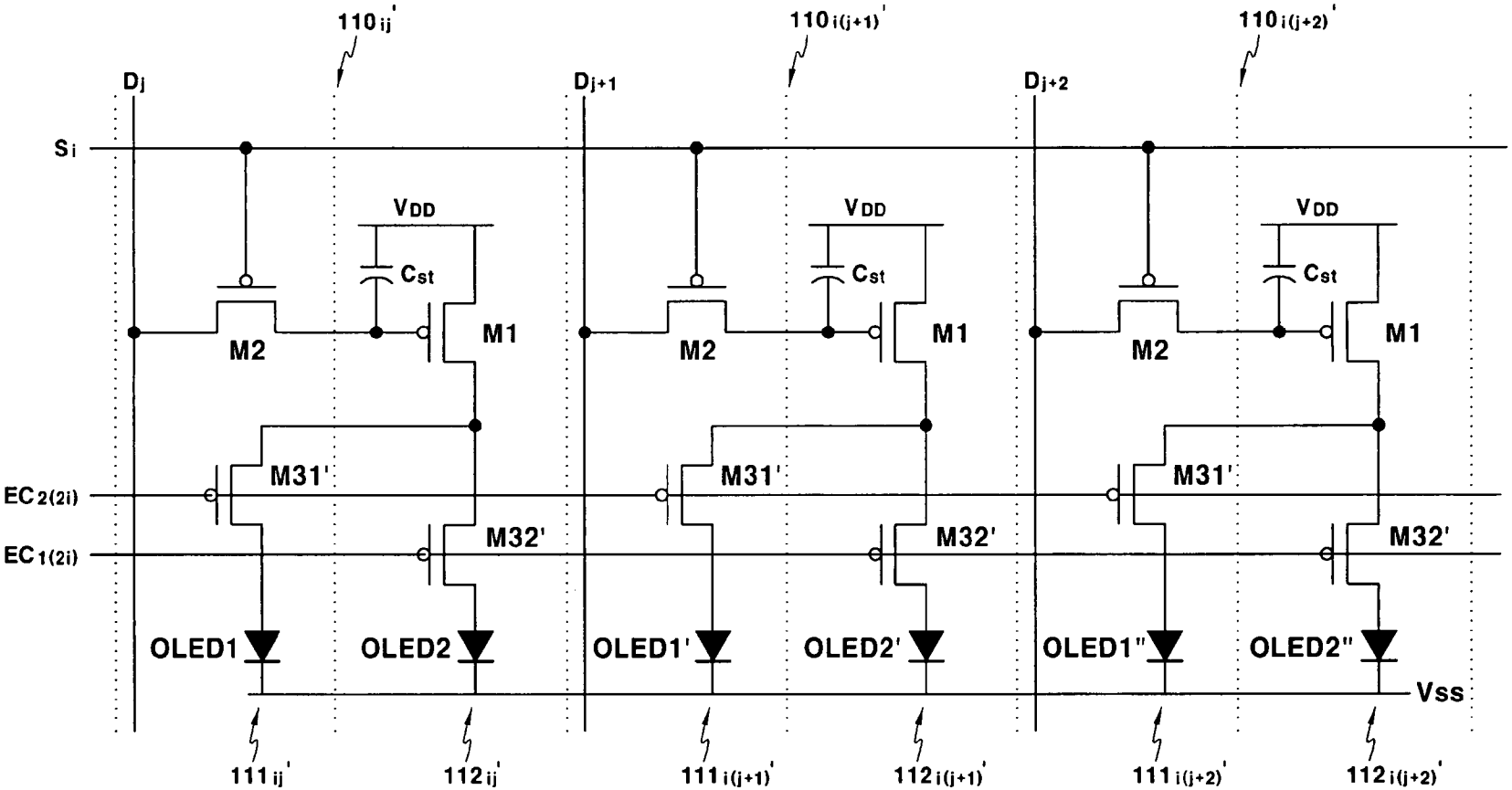
FIG. 7B shows a diagram for representing six pixels in the pixel area of an even row according to the second exemplary embodiment of the present invention.

As shown in FIG. 7B, gates of the transistors M32' of the right pixels $\mathbf{112}_{ij}'$, $\mathbf{112}_{i(j+1)}'$, $\mathbf{112}_{i(j+2)}'$ among the pixels in the pixel area $\mathbf{110}_{ij}'$, $\mathbf{110}_{i(j+1)}'$, $\mathbf{110}_{i(j+2)}'$ of the even row are coupled to the emission scan line $EC_{1(2i)}$, and gates of the transistors M31' of the left pixels $\mathbf{111}_{ij}$, $\mathbf{111}_{i(j+1)}$, $\mathbf{111}_{i(j+2)}$ are coupled to the emission scan line $EC_{2(2i)}$.

Accordingly, the right pixels in the pixel areas 110' of the even rows are emitted when the emission signals are sequentially applied to the emission scan lines $EC_{11}$ to $EC_{1m}$ in the first field, and the left pixels in the pixel areas 110' of the even rows are emitted when the emission signals are sequentially applied to the emission scan lines $EC_{21}$ to $EC_{2m}$ in the second field.

Figure 8A:
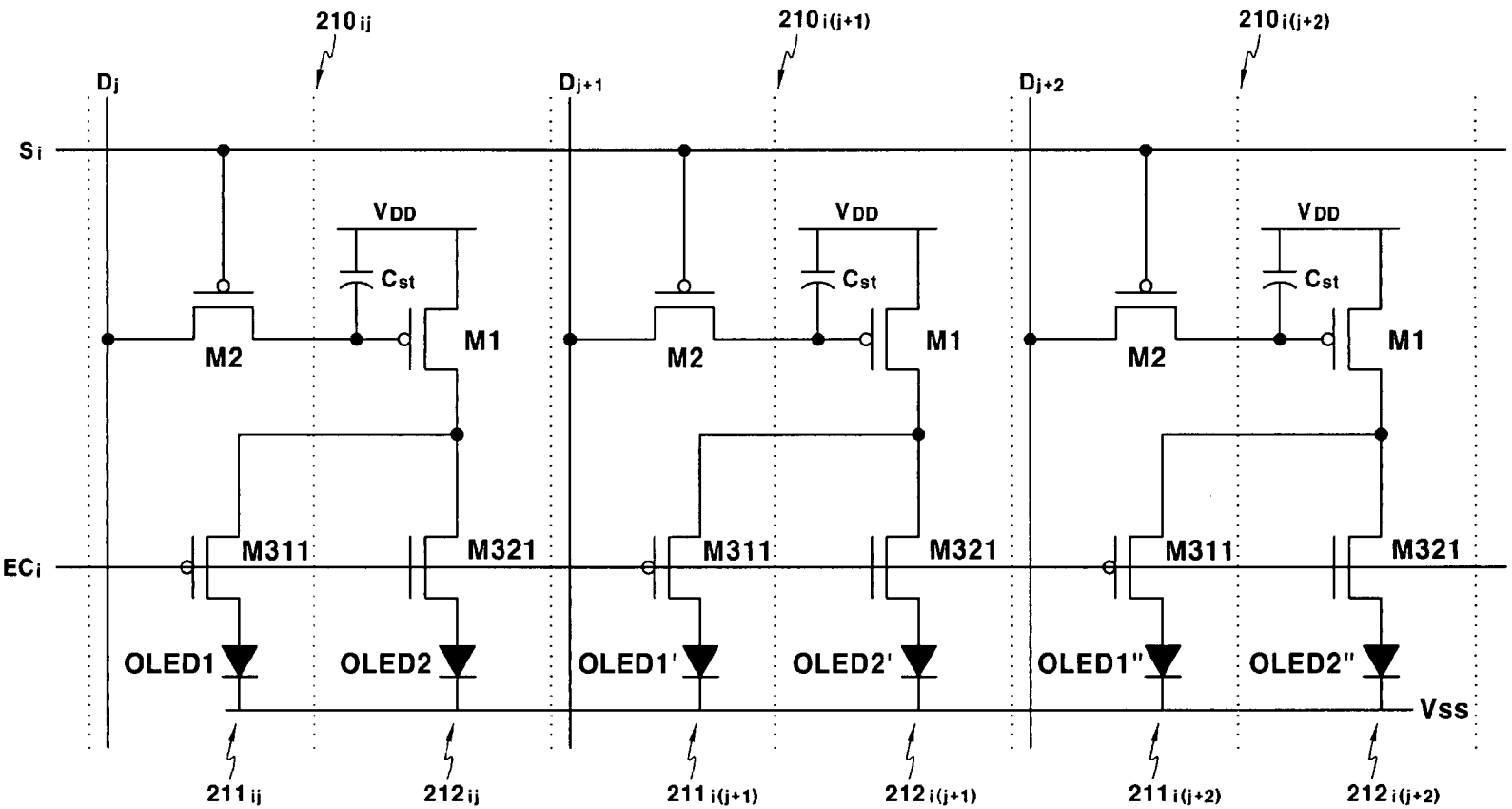
FIG. 8A shows a diagram for representing pixels in an odd rows according to a third exemplary embodiment of the present invention.
Figure 8B:
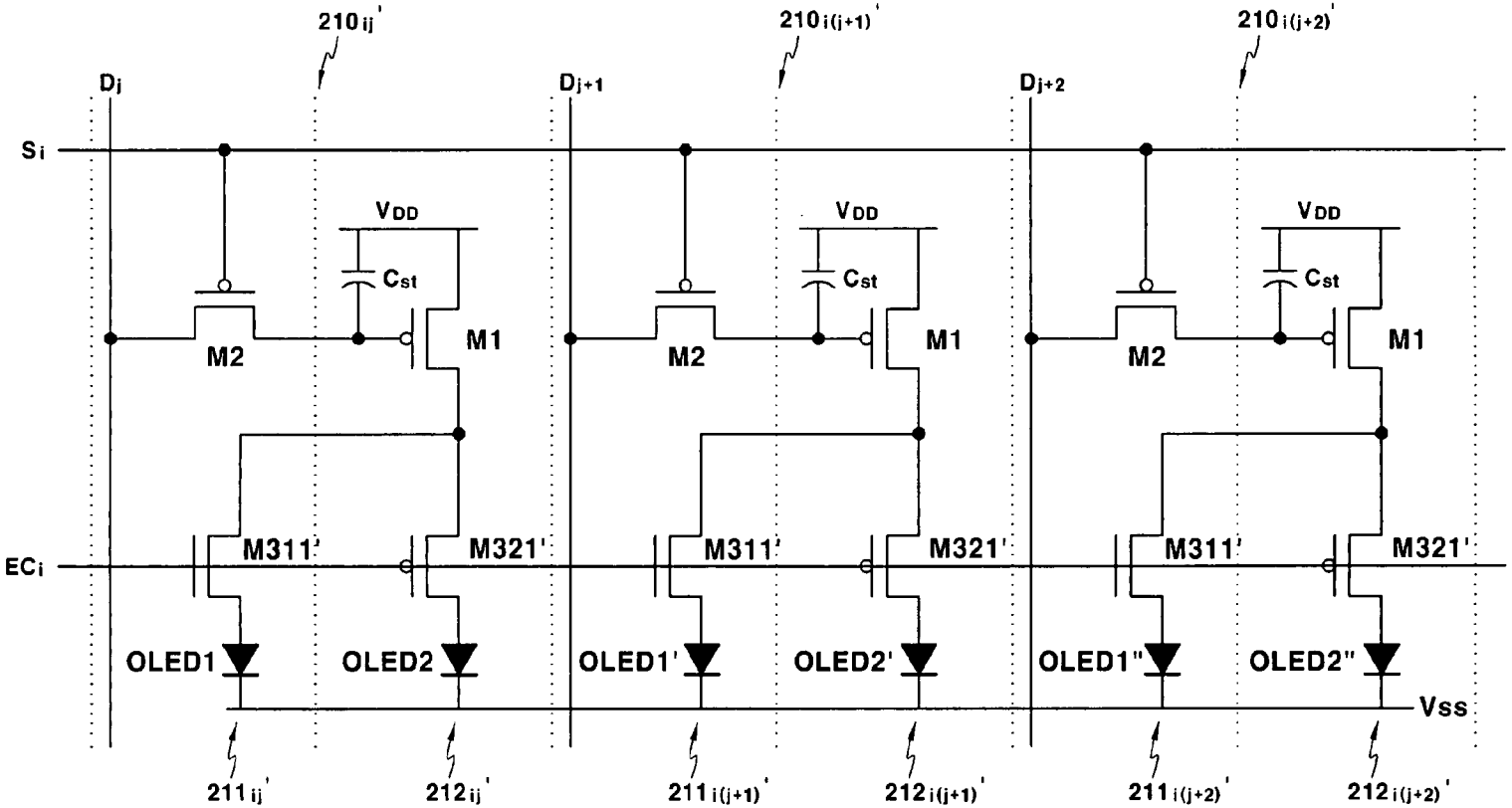
FIG. 8B shows a diagram for representing pixels in an even row according to the third exemplary embodiment of the present invention.

FIGS. 8A and 8B show circuit diagrams of pixels according to a third exemplary embodiment of the present invention. FIG. 8A shows a diagram for representing a pixel in the odd rows, and FIG. 8B shows a diagram for representing a pixel in the even rows.

The pixels according to the third exemplary embodiment of the present invention differ from those according to the first and the second exemplary embodiments of the present invention because the pixels according to the third exemplary embodiment of the present invention establishes the transistors M311 and M321 (or M311' and M321') included in the pixels to have different channel types from each other, and the gates of the transistors M311 and M321 (or M311' and M321') are coupled to the same (or one) emission line $EC_i$.

As shown in FIG. 8A, P-channel transistors form the transistors M311 of the left pixels $\mathbf{211}_{ij}$, $\mathbf{211}_{i(j+1)}$, $\mathbf{211}_{i(j+2)}$ in the pixel areas $\mathbf{210}_{ij}$, $\mathbf{210}_{i(j+1)}$, $\mathbf{210}_{i(j+2)}$ of the odd rows, N-channel transistors form the transistors M321 of the right pixels $\mathbf{212}_{ij}$, $\mathbf{212}_{i(j+1)}$, $\mathbf{212}_{i(j+2)}$ in the pixel areas $\mathbf{210}_{ij}$, $\mathbf{210}_{i(j+1)}$, $\mathbf{210}_{i(j+2)}$ of the odd rows, and the emission signals emit1[1] to emit1[m] shown in FIG. 3 are applied to the emission scan line $EC_i$. The transistor M311 is turned on and the current of the transistor M1 is transmitted to the organic LE diode OLED1, OLED1', or OLED1" in the first field, and the transistor M321 is turned on and the current of the transistor M1 is transmitted to the organic LE diode OLED2, OLED2', or OLED2" in the second field.

As shown in FIG. 8B, P-channel transistors form the transistors M311' of the right pixels $\mathbf{212}_{ij}'$, $\mathbf{212}_{i(j+1)}'$, $\mathbf{212}_{i(j+2)}'$ in the pixel areas $\mathbf{210}_{ij}'$, $\mathbf{210}_{i(j+1)}'$, $\mathbf{210}_{i(j+2)}'$ of the even rows, N-channel transistors form the transistors M321' of the left pixels $\mathbf{211}_{ij}'$, $\mathbf{211}_{i(j+1)}'$, $\mathbf{211}_{i(j+2)}'$ in the pixel areas $\mathbf{210}_{ij}'$, $\mathbf{210}_{i(j+1)}'$, $\mathbf{210}_{i(j+2)}'$ of the even rows, and the emission signals emit1[1] to emit1[m] shown in FIG. 3 are applied to the emission scan line $EC_i$. The transistor M321' is turned on and the current of the transistor M1 is transmitted to the organic LE diode OLED2, OLED2', or OLED2" in the first field, and the transistor M311' is turned on and the current of the transistor M1 is transmitted to the organic LE diode OLED1, OLED1', or OLED1" in the second field.

Accordingly, the left pixels $\mathbf{211}_{ij}$, $\mathbf{211}_{i(j+1)}$, $\mathbf{211}_{i(j+2)}$ in the pixel areas $\mathbf{210}_{ij}$, $\mathbf{210}_{i(j+1)}$, $\mathbf{210}_{i(j+2)}$ of the odd rows and the right pixels $\mathbf{212}_{ij}'$, $\mathbf{212}_{i(j+1)}'$, $\mathbf{212}_{i(j+2)}'$ in the pixel areas $\mathbf{210}_{ij}'$, $\mathbf{210}_{i(+1)}'$, $\mathbf{210}_{i(j+2)}'$ of the even rows are emitted in the first field, and the right pixels $\mathbf{212}_{ij}$, $\mathbf{212}_{i(j+1)}$, $\mathbf{212}_{i(j+2)}$ in the pixel areas $\mathbf{210}_{ij}$, $\mathbf{210}_{i(j+1)}$, $\mathbf{210}_{(j+2)}$ of the odd rows and the left pixels $\mathbf{211}_{ij}'$, $\mathbf{211}_{i(j+1)}'$, $\mathbf{211}_{i(j+2)}'$ in the pixel areas $\mathbf{210}_{ij}'$, $\mathbf{210}_{i(j+1)}'$, $\mathbf{210}_{i(j+2)}'$ of the even rows are emitted in the second field.

In general, an exemplary embodiment of the present invention establishes pixels of a first group formed in pixel areas to be emitted by emission signals in a first field, and pixels of a second group to be emitted in a second field. In an enhancement of the exemplary embodiment of the present invention, the enhanced exemplary embodiment establishes the first group and the second group to have at least one non-emitting pixel between emitting pixels in the respective fields, and therefore the vertical stripe on the display panel is eliminated.

While it has been shown that the odd row pixels and the even row pixels are alternately coupled to the emission scan line in the first field and the second field in the above shown exemplary embodiments, it is to be understood that the invention is not limited to the shown exemplary embodiments, but, on the contrary, the present invention is intended to cover various modifications in which connections of the pixels may be varied for the purpose of providing at least one non-emitting pixel between the emitting pixels in the respective fields.

While two pixels are provided in a pixel area and a frame is divided into two fields in the above exemplary embodiments, three pixels may be provided in a pixel area and a frame may be divided into three fields in another exemplary embodiment.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A display device comprising:

a display area comprising a plurality of data lines for transmitting data signals for displaying an image, a plurality of first scan lines for transmitting selection signals, a plurality of second scan lines and a plurality of third scan lines for respectively transmitting first and second emission signals, and a plurality of pixels respectively at a plurality of pixel areas defined by the data lines and the first scan lines, wherein one of the pixel areas comprises a first pixel and a second pixel of the plurality of pixels, the first pixel and the second pixel coupled to one of the data lines and one of the first scan lines, a driving circuit coupled to the first pixel and the second pixel for outputting an output current corresponding to at least one of the data signals, and another one of the pixel areas adjacent to the one of the pixel areas comprising a third pixel and a fourth pixel of the plurality of pixels, the third pixel and the fourth pixel coupled to the one of the data lines;

a first driver for transmitting the selection signals to the one of the first scan lines in a plurality of fields forming a frame;

a second driver for transmitting at least one of the first emission signals to one of the second scan lines to emit the first pixel in a first field of the plurality of fields; and a third driver for transmitting at least one of the second emission signals to one of the third scan lines to emit the second pixel in a second field of the plurality of fields, wherein the first and third pixels are at a first side of the one of the data lines and the second and fourth pixels are at a second side of the one of the data lines, wherein the first and fourth pixels are configured to emit in the first field, and the second and third pixels are configured to emit in the second field, and wherein each of the plurality of pixels comprises an emitter configured to emit light corresponding to the output current, and wherein one of the pixel areas comprises a first switch configured to be controlled by a corresponding one of the first emission signals and a second switch configured to be controlled by a corresponding one of the second emission signals to apply the output current of the driving circuit to the emitter, and the switches of a same one of the pixel areas are configured to be alternately turned on.

2. The display device of claim 1, wherein the first pixel belongs to a first group and wherein the first group has at least one non-emitting pixel between neighboring emitting pixels that are emitted by the at least one of the first emission signals in the first field.

3. The display device of claim 2, wherein the second pixel belongs to a second group and wherein the second group has at least one non-emitting pixel between neighboring emitting pixels that are emitted by the at least one of the second emission signals in the second field.

4. The display device of claim 1, wherein the first pixel belongs to a first group, wherein the second pixel belongs to a second group, and wherein a first data signal of the data signals corresponding to the first pixel is applied to the one of the data lines while at least one of the selection signals is applied in the first field, and a second data signal corresponding to the second pixel is applied to the one of the data lines while the at least one of the selection signals is applied in the second field.

5. The display device of claim 1, wherein the first pixel comprises the first switch and the second pixel comprises the second switch.

6. The display device of claim 5, wherein the driving circuit comprises a transistor for outputting the output current corresponding to at least one of the data signals, a switch for transmitting the at least one of the data signals to the transistor in response to at least one of the selection signals, and a capacitor for maintaining a voltage between a source and a gate of the transistor.

7. The display device of claim 1, wherein the first pixel is on a first side of the one of the pixel areas and is emitted by an odd scan line of the second scan lines, and wherein the second pixel is on a second side of the one of the pixel areas and is emitted by an odd scan line of the third scan lines.

8. The display device of claim 7, wherein the third pixel is on the first side emitted by an even scan line of the third scan lines; and the fourth pixel is on the second side emitted by an even scan line of the second scan lines.

9. A display device comprising:

a display area comprising a plurality of data lines for transmitting data signals for displaying an image, a plurality of first scan lines for transmitting selection signals, a plurality of second scan lines for transmitting emission signals having a first level voltage and a second level voltage different from the first level voltage, and a plurality of pixels respectively at a plurality of pixel areas defined by the data lines and the first scan lines, wherein one of the pixel areas comprises a first pixel of the plurality of pixels belonging to a first group and a second pixel of the plurality of pixels belonging to a second group, the first pixel and the second pixel coupled to one of the data lines and one of the first scan lines, a driving circuit coupled to the first pixel and the second pixel for outputting an output current corresponding to one of the data signals, and another one of the pixel areas adjacent to the one of the pixel areas comprising a third pixel and a fourth pixel of the plurality of pixels, the third pixel and the fourth pixel coupled to the one of the data lines;

a first driver for transmitting the selection signals to the one of the first scan lines in a plurality of fields forming a frame; and a second driver for sequentially transmitting the emission signals having the first level voltage to at least one of the second scan lines to emit the first pixel in a first field of the plurality of fields and transmitting the emission signals having the second level voltage to at least one of the second scan lines to emit the second pixel in a second field of the plurality of fields, wherein the first and third pixels are at a first side of the one of the data lines and the second and fourth pixels are at a second side of the one of the data lines, wherein the first and fourth pixels are configured to emit in the first field, and the second and third pixels are configured to emit in the second field, and wherein each of the plurality of pixels comprises an emitter configured to emit light corresponding to the output current, and wherein one of the pixel areas comprises a first switch configured to be controlled by a corresponding one of the emission signals and a second switch configured to be controlled by another corresponding one of the emission signals, to apply the output current of the driving circuit to the emitter, and the switches of a same one of the pixel areas are configured to be alternately turned on.

10. The display device of claim 9, wherein the first group has at least one non-emitting pixel between neighboring emitting pixels that are emitted by the emission signals having the first level voltage in the first field, and wherein the second group has at least one non-emitting pixel between neighboring emitting pixels that are emitted by the emission signals having the second level voltage in the second field.

11. The display device of claim 9, wherein the first pixel comprises the first switch, and wherein the second pixel comprises the second switch.

12. The display device of claim 11, wherein the driving circuit comprises a transistor for outputting the output current corresponding to at least one of the data signals, a switch for transmitting the at least one of the data signals to the transistor in response to at least one of the selection signals, and a capacitor for maintaining a voltage between a source and a gate of the transistor.

13. The display device of claim 11, wherein the switch of the first pixel is turned on by responding to at least one of the emission signals having the first level voltage and the switch of the second pixel is turned on by responding to the at least one of the emission signals having the second level voltage.

14. A display device comprising:

a plurality of data lines for transmitting data signals for displaying an image;

a plurality of first scan lines for transmitting selection signals in a first field and a second field;

a plurality of second scan lines for transmitting first emission signals in the first field;

a plurality of third scan lines for transmitting second emission signals in the second field; and a plurality of pixels grouped into a plurality of pixel areas, wherein one of the pixel areas comprises a first pixel and a second pixel of the plurality of pixels coupled to one of the data lines and one of the first scan lines belonging to a first group of the first scan lines, wherein the first pixel comprises a first switch responsive to at least one of the first emission signals to emit the first pixel, and the second pixel comprises a second switch responsive to at least one of the second emission signals to emit the second pixel, wherein another one of the pixel areas adjacent to the one of the pixel areas comprises a third pixel and a fourth pixel of the plurality of pixels coupled to the one of the data lines and another one the first scan lines belonging to a second group of the first scan lines, the third pixel comprises a third switch responsive to at least one of the second emission signals to emit the third pixel, and the fourth pixel comprises a fourth switch responsive to at least one of the first emission signals to emit the fourth pixel, wherein the first and third pixels are at a first side of the one of the data lines and the second and fourth pixels are at a second side of the one of the data lines, and the first and fourth pixels are configured to emit in the first field, and the second and third pixels are configured to emit in the second field, and wherein each of the plurality of pixels comprises an emitter configured to emit light and a switch configured to be controlled by a corresponding one of the first emission signals or the second emission signals to apply an output current of a driving circuit to the emitter, and the switches of a same one of the pixel areas are configured to be alternately turned on.

15. The display device of claim 14, wherein the first scan lines of the first group are odd first scan lines and the first scan lines of the second group are even first scan lines.

16. The display device of claim 14, further comprising a first driver for driving the data lines, and second, third, and fourth drivers for respectively driving the first scan lines, the second scan lines, and the third scan lines.

17. A display device comprising:

a plurality of data lines for transmitting data signals for displaying an image;

a plurality of first scan lines for transmitting selection signals in a first field and a second field;

a plurality of second scan lines for transmitting a first level emission signal in the first field and transmitting a second level emission signal in the second field; and a plurality of pixels grouped into a plurality of pixel areas, wherein each of the pixel areas is associated with one of the data lines and one of the first scan lines and comprises a first pixel and a second pixel of the plurality of pixels, wherein the first pixel comprises a switch responsive to the first level emission signal to emit the first pixel and the second pixel comprises a switch responsive to the second level emission signal to emit the second pixel, wherein in a first group of the pixel areas the first pixel is closer to one edge of the display device than the second pixel and in a second group of the pixel areas the second pixel is closer to the one edge of the display device than the first pixel, wherein the first pixel of a first pixel area among the pixel areas and the second pixel of a second pixel area among the pixel areas adjacent to the first pixel area are at a first side of a corresponding one of the data lines, and the second pixel of the first pixel area and the first pixel of the second pixel area are at a second side of the corresponding one of the data lines, and wherein each of the plurality of pixels comprises an emitter configured to emit light, and the switch configured to be controlled by a corresponding one of the emission signals to apply an output current of a driving circuit to the emitter, and the switches of a same one of the pixel areas are configured to be alternately turned on.

18. The display device of claim 17, wherein the pixel areas of the first group are coupled to odd scan lines of the plurality of first scan lines, and wherein the pixel areas of the second group are coupled to even scan lines of the plurality of first scan lines.

19. The display device of claim 17, wherein each of the pixel areas further comprises the driving circuit for outputting the output current corresponding to at least one of the data signals, and wherein each of the first pixel and the second pixel of each of the pixel areas comprises the emitter for emitting light corresponding to an applied current and the switch for applying the output current of the driving circuit to the emitter in response to the first and the second level emission signals.

20. A method for driving a display comprising a plurality of data lines for transmitting data signals for displaying an image, a plurality of first scan lines for transmitting selection signals, and a plurality of pixels respectively at a plurality of pixel areas defined by the data lines and the first scan lines, each of the plurality of pixels comprising an emitter, wherein at least two pixels of the plurality of pixels and a driving circuit coupled to the at least two pixels sharing one of the data lines and one of the first scan lines are formed in each of a subset of the plurality of pixel areas and belonging to a first group or a second group, the method comprising:

a) sequentially applying selection signals to the plurality of first scan lines in a first field;

b) programming at least one of the data signals corresponding to the first group onto at least one of the data lines;

c) applying emission signals to a first switch of each pixel of the first group to emit the emitter of each pixel of the first group such that the driving circuit outputs an output current through the first switch to the emitter of one of the at least two pixels corresponding to the at least one of the data signals;

d) applying the selection signals to at least one of the first scan lines in a second field;

e) programming at least another one of the data signals corresponding to the second group onto at least one of the data lines; and f) applying the emission signals to a second switch of each pixel of the second group to emit the emitter of each pixel of the second group such that the driving circuit outputs another output current through the second switch to the emitter of the other one of the at least two pixels corresponding to the at least another one of the data signals, wherein each pixel of the first group and each pixel of the second group are established to have at least one non-emission pixel between neighboring emitting pixels in the first and the second fields, wherein a first pixel of a first pixel area of the first group and a third pixel of a second pixel area of the second group adjacent to the first pixel area are at a first side of a corresponding one of the data lines, and a second pixel of the first pixel area and a fourth pixel of the second pixel area are at a second side of the corresponding one of the data lines, wherein the first and fourth pixels are configured to emit in the first field, and the second and third pixels are configured to emit in the second field, and wherein the switches of a same one of the pixel areas are configured to be alternately turned on.

* * * * *